US006513998B1

(12) United States Patent
Barry

(10) Patent No.: US 6,513,998 B1
(45) Date of Patent: Feb. 4, 2003

(54) SCOURING GLOVES

(76) Inventor: Essie M Barry, 29606 Middlebelt Rd., suite 2801 Farmington, Hills, MI (US) 48334

( * ) Notice: Subject to any disclaimer, the term of this patent is extended or adjusted under 35 U.S.C. 154(b) by 0 days.

(21) Appl. No.: 09/945,963

(22) Filed: Sep. 4, 2001

(51) Int. Cl.[7] ..... A46B 5/04
(52) U.S. Cl. ..... 401/7; 401/196
(58) Field of Search ..... 44/7, 196, 6, 8

(56) References Cited

U.S. PATENT DOCUMENTS

| | | | | |
|---|---|---|---|---|
| 1,346,683 A | | 7/1920 | Reynolds | |
| 2,030,494 A | | 2/1936 | Bireley et al. | |
| 3,643,386 A | | 2/1972 | Grzyll | |
| 3,778,172 A | * | 12/1973 | Myren | 401/7 |
| 4,593,427 A | | 6/1986 | Ortolivo | |
| 4,621,388 A | | 11/1986 | Ortolivo | |
| 4,980,943 A | | 1/1991 | Barber | |
| 5,169,251 A | * | 12/1992 | Davis | 401/7 |
| 5,441,355 A | * | 8/1995 | Moore | 401/7 |
| 6,000,060 A | | 12/1999 | Borucki-Mastej | |
| 6,098,234 A | | 8/2000 | Jackson, Jr. | |

FOREIGN PATENT DOCUMENTS

| | | |
|---|---|---|
| GB | 2 108 372 A | 5/1983 |
| GB | 2 260 889 A | 5/1993 |
| WO | PCT/US96/07835 | 12/1996 |

* cited by examiner

*Primary Examiner*—David J. Walczak
(74) *Attorney, Agent, or Firm*—Michael I. Kroll

(57) ABSTRACT

A scouring glove with a plurality of heavy duty cleaning members 16 placed at the glove's distal ends of the fingertips for increased scouring ability along with a soap permeable abrasive inner palm layer 18 containing a soap containment bladder 30 with a soap fill spout 22 for refilling. A one-way valve 32 is provided to prevent soap egress and allow pressure buildup in the bladder 30. A semi-rigid siding 36 is provided to keep the bladder's form. A plurality of soap dispensing apertures 26 are provided to selectively distribute the soap 38 contained within the bladder 30 to prime cleaning areas.

4 Claims, 9 Drawing Sheets

SCOURING GLOVES

BACKGROUND OF THE INVENTION

1. Field of the Invention

The present invention related generally to gloves and more specifically to gloves having a substance incorporated therein within a description of the purpose and product imprinted on the packaging or accompanying literature. The gloves have a permeable inner palm layer and a compartment for the storage of additional material.

2. Description of the Prior Art

There are other hand coverings designed for cleaning. Typical of these is U.S. Pat. No. 1,346,683 issued to Reynolds on Jul. 13, 1920.

Another patent was issued to Bireley et al on Apr. 30, 1935 as U.S. Pat. No. 2,030,494. Yet another U.S. Pat. No. 3,151,333 was issued to Scholz on Oct. 6, 1964 and still yet another was issued on Feb. 22, 1972 to Grzyll as U.S. Pat. No. 3,643,386.

Another patent was issued to Ortolivo on Jun. 10, 1986 as U.S. Pat. No. 4,593,427. Yet another U.S. Pat. No. 4,621,388 was issued to Ortolivo on Nov. 11, 1986. Another was issued to Barber on Jan. 1, 1991 as U.S. Pat. No. 4,980,943 and still yet another was issued on Dec. 14, 1999 to Borucki-Mastej as U.S. Pat. No. 6,000,060.

Another patent was issued to Jackson on Aug. 8, 2000 as U.S. Pat. No. 6,098,234. Yet another U.K. Patent No. GB 2,108,372 was issued to Hendrie on Nov. 1, 1982. Another was issued to Stone on Oct. 30, 1991 as U.K. Patent No. GB 2,260,889 and still yet another was issued on Dec. 5, 1996 to Moore as WIPO Patent No. WO 96/38061.

A hand covering a textile body, and a rubber membrane vulcanized upon the outer surface only of the body said membrane having a plurality of closely-arranged definite projections forming a roughened gripping surface approximately coextensive with the palm and finger portions of the textile body, the area uncovered by the projections being slight relative to covered by them.

A device of the character described, comprising: a flexible and impervious covering for the hand of a user; and a flexible pad on the outer surface of the covering; the body of the pad being of erasive rubber-like material having spaced absorbent fibers embedded therein and held thereby; and, said fibers being exposed at the outer surface of the pad, and extending obliquely inward therefrom.

A hand covering having an abrasive surface for foods and the like comprising, in combination an inner fabric liner having palm, finger, and thumb portions and an outer surface, an impervious flexible material bonded to said liner outer surface forming a continuous film thereover, an outer surface defined on said film, a plurality of sharp-edged, abrasive granules bonded to said film outer surface, said granules being located on said film outer surface on palm portion, the inside of said finger portion, and entirely over and about said thumb portion.

Hand apparels, gloves and mittens, having abrasive material secured to the hand apparel at effective working areas such as extending beyond and partially around an extending member, finger or thumb, to avoid cleaning and abrading contact with an objecting while providing various advantages and protections to the user.

There is herein disclosed a cleaning and scouring glove having a flexible body including a palm, a thumb, and finger stalls, the finger stalls including a second row of phalanges.

Disposed upon the second row of phalanges in the knuckle area of the middle three fingers are three ovoid scouring or cleaning units. In the palm and inner-finger region is located an upper and lower cleaning or abrasive surface, the upper surface covering substantially the entire upper-palm and inner-finger area, and the lower surface covering substantially the entire lower-palm area, the upper and lower surfaces being separated by a transverse linear separation of about ⅛ inch, this linear separation corresponding generally to the natural transverse fold in the palm, the separation functioning to enhance the flexibility of the palm area of the glove to facilitate the complete clenching of the fist of the user in order to make possible the application of considerable force and pressure by the user when the cleaning glove is held in a position of a clenched fist with pressure and reciprocal motion applied by the user between the second row of phalanges of the knuckle and the rigid surface to be cleaned by the disclosed waterproof cleaning glove. Also disclosed are means for the attachment and removability of the cleaning surfaces and units to provide a range of different cleaning mechanisms. The cleaning units may include a cellulose layer capable of rotating detergent in solution.

There is herein disclosed a cleaning scouring glove having a flexible body including a palm, a thumb, and finger stalls. Disposed upon the stalls are scouring or cleaning units with flanges around the units. Also disclosed is a sponge for the attachment and removability from the glove below the scouring or cleaning units.

A cleaning glove which includes a glove base having a side to which there is attached a primary layer of a tufted blended yarn tufted to the glove base and one or more fibrous bristle portions or strips. The blended yarn is made by weaving together three or more individual yarns including one yarn made of acrylic fibers, wool fibers or polyester fibers.

A waterproof, scouring glove comprising a glove-like sheath having an abrasive material disposed along the entire outer surface so that a user may scour a kitchen implement or similar item without the need to grasp a separate scouring pad or sponge.

A cleaning system that is convenient and efficient. The cleaning system includes a glove assembly, a wash cloth assembly, and a buffer cloth assembly. The glove assembly includes a cloth glove shell with an elastic wrist band, six hook and pile scrubber fasting sections, six detachable scrub sections, an elongated accessory hook and pile fastener strip secured to the palm area of the glove shell, and a glove assembly soap receiving compartment within the glove shell that is accessible through an access opening formed through an interior palm surface of the glove shell and having a hook and pile closure sealing flap for sealing the access opening.

A glove 1 comprises thumb and finger sections 2,3 and a palm section 4. A pad 5,7 of scouring material is secured to the glove to provide a scouring surface on the glove useful in the kitchen or garden.

A protective glove having releasable attached to a portion of its outer surface (22) a pad (24) of a resiliently compressible material having a thickness of at least 1 mm (preferably in the range of 2 to 15 mm) and an abrasive material releasable attached to the Waterproof manual cleaning device such as latex mitts and gloves having cleaning pads (34) bonded thereto. The cleaning pads may be bonded directly to the mitts or gloves without use of adhesives. The mitt glove may be stripped from the former (10) without turning the device inside out. A raised border portion (24) may be provided to prevent misalignment of the pad while latex is cured. The gloves may have finger portions of generally rectangular cross section to facilitate bonding of the pads on one or both sides of the glove.

SUMMARY OF THE PRESENT INVENTION

The present invention discloses a scouring glove with a plurality of heavy duty cleaning members placed at the glove's distal ends of the fingertips for increased scouring ability along with a soap permeable abrasive inner palm layer containing a soap containment bladder with a soap fill spout for refilling. A one-way valve is provided to prevent soap egress and allow pressure buildup in the bladder. A semi-rigid siding is provided to keep the bladder's form. A plurality of soap dispensing apertures are provided to selectively distribute the soap contained within the bladder to prime cleaning areas.

The following is an illustration to typify some of the uses of the gloves/mittens along with the general purpose. A glove/mitten for cosmetic use such as, gloves/mittens having a dermabrasion to remove old dead cells from skin. Gloves/mittens having lotions or oils for body application such as a masseuse uses in a message. Gloves/mittens for the hair dressing industry to apply shampoo to wet hair before the thorough shampoo.

A glove/mitten for the cleaning industry used to dispense cleaning solution to walls, cabinets, etc., for spot cleaning. Gloves/mittens that can be used in a first dry application to remove small amounts of lint from clothing for an immediate removal.

Gloves/mittens having a battery incorporated therein working in concert with organic materials such as piezoelectric crystal to aid in the abrasive movement of the glove. Gloves/mittens used for cleaning and scouring of typically dishes and pots with the glove or mitten having a soap permeable abrasive inner palm layer with a soap containment bladder contained therein and a plurality of heavy duty cleaning members placed at the distal ends of the fingertips of the glove or mitten for extensive scouring.

The soap permeable abrasive inner palm layer serves to provide an additional scouring surface, a means for containing and protecting the soap containment bladder and a transferable medium for the distribution throughout its inner surface of the soap extruded from the soap containment bladder. The soap containment bladder serves to receive and distribute soap poured into the glove by means of a fill spout located at the distill end of the glove or mitten where the users hand enters having a liquid tight interlocking seal for closing. A one way valve is positioned within the conduit leading from the soap fill spout to the soap containment bladder to permit fluid into the bladder but preventing egress of the cleaning solution when pressure is applied to the soap containment bladder, this is so that ample pressure may be produced therein for the discharge of the contained cleaning solution through the soap dispensing apertures. The soap containment bladder also has a semi-rigid siding to keep its form in the glove.

A primary object of the present invention is to provide souring gloves that have a plurality of heavy duty cleaning members attached to the distal ends of the gloves fingertips for increased scouring ability.

Another object of the present invention is to provide scouring gloves that have a soap permeable abrasive inner palm layer to provide additional surface area for cleaning.

Yet another object of the present invention is to provide scouring gloves with a soap-containing bladder contained within a soap permeable abrasive inner palm layer for soap distribution.

Still yet another object of the present invention is to provide scouring gloves with a one way valve to prevent egress of fluid poured into the soap containing bladder so pressure within the bladder may be produced.

Yet another object of the present invention is to provide scouring gloves that have a soap fill spout with a liquid tight interlocking seal so soap may be poured into the soap containment bladder and closed.

Still yet another object of the present invention is to provide scouring gloves with a semi rigid siding on the soap containment bladder so that it may keep form inside the glove.

Yet another object of the present invention is to provide scouring gloves with a plurality of soap distribution apertures so that soap is distributed selectively to prime areas for cleaning of the abrasive inner palm member.

Additional objects of the present invention will appear as the description proceeds.

The present invention overcomes the shortcomings of the prior art by providing a scouring gloves with a plurality of heavy duty cleaning members placed at the gloves distal ends of the fingertips for increased scouring ability with a soap permeable abrasive inner palm layer containing a soap containment bladder with a soap fill spout for refilling, a one way valve to prevent soap egress and allow pressure buildup in the bladder, a semi rigid siding to keep the bladders form and a plurality of soap dispensing apertures to selectively distribute the soap contained within the bladder to prime cleaning areas.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
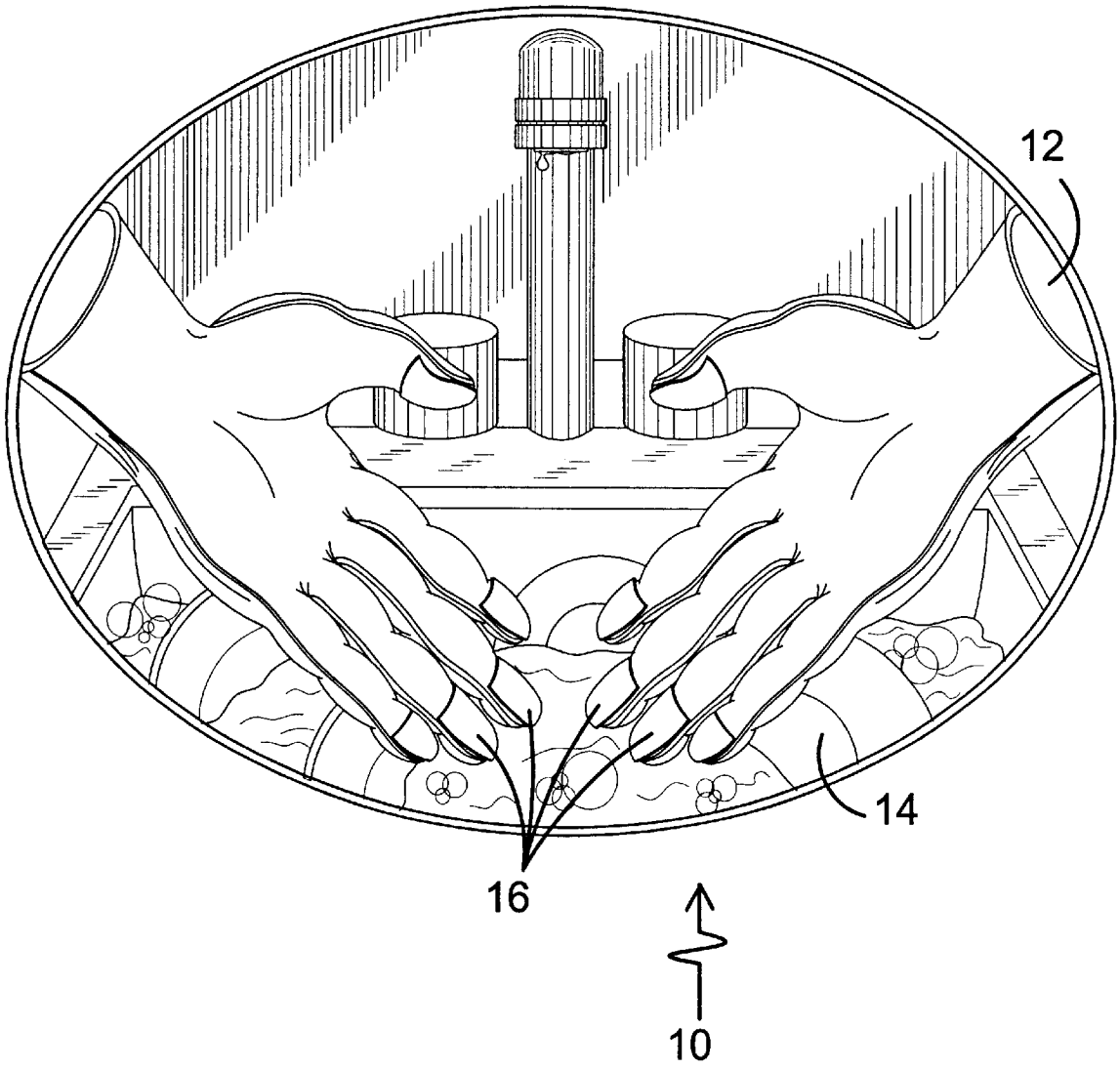
FIG. 1 is a perspective view of the present invention in use.

With to reference numerals used, the following numbering is used throughout the drawings.

10 present invention
12 user
14 dishes
16 cleaning member
18 inner palm layer
20 glove body
22 soap fill spout
24 liquid seal
26 soap dispensing apertures
28 inner storage cavity
30 soap containment bladder
32 one-way valve
34 conduit
36 semi-rigid siding
38 soap solution
40 arrow
42 wrist area
44 opening

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments, practitioners skilled in the art will recognize numerous other embodiments as well. For definition of the complete scope of the invention, the reader is directed to appended claims.

Turning to FIG. 1, shown therein is a perspective view of the present invention 10 in use. Shown is the present invention being worn by the user 12 to wash a sink full of dishes 14 with the fingertips of the cleaning glove having heavy duty cleaning members 16 attached thereto.

Figure 2:
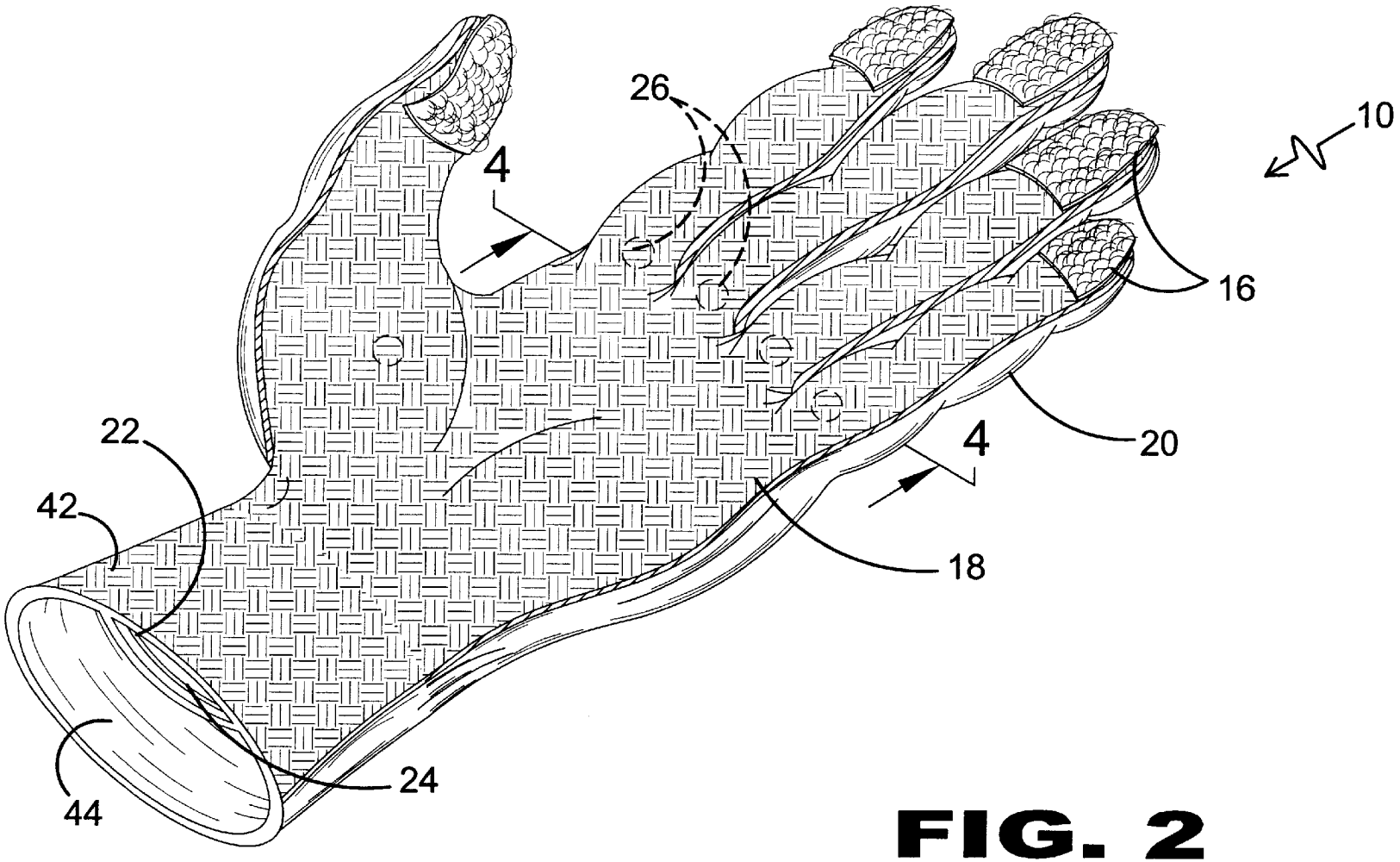
FIG. 2 is a isometric view of the present invention.

Turning to FIG. 2, shown therein is a isometric view of the present invention 10. Shown is the present invention with an exterior slightly abrasive inner palm layer 18 on the bottom of the glove that serves several functions first being an abrasive cleaning surface function to protect the soap containment bladder from damage and another to provide means for applying pressure to the soap dispensing bladder thereby selectively dispensing soap out the dispensing bladder. Also shown are cleaning members 16, the glove body 20, soap fill spout 22, interlocking liquid tight seal 24 and soap dispensing apertures 26. The glove body has a defined wrist area 42 having an opening 44 therein for insertion of the hand of the user.

Figure 3:
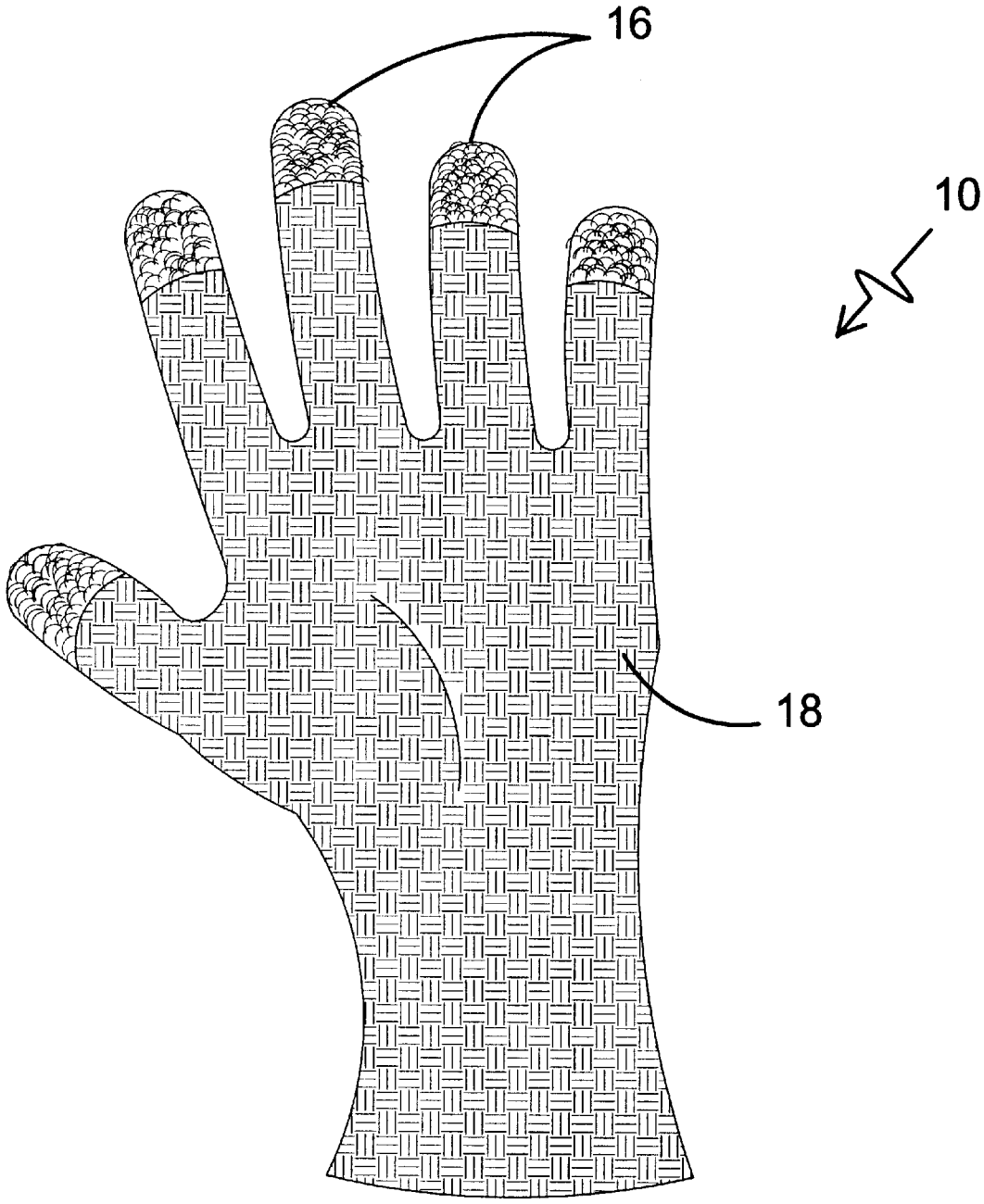
FIG. 3 is a bottom view of the present invention.

Turning to FIG. 3, shown therein is a bottom view of the present invention 10. Shown is the present invention having a plurality of heavy duty cleaning members 16 attached to the distal ends of the finger receptacles of the cleaning glove to provide a courser abrasive element. The abrasive inner palm layer 18 is to hold water and soap in solution over the entire interior-cleaning surface of the glove.

Figure 4:
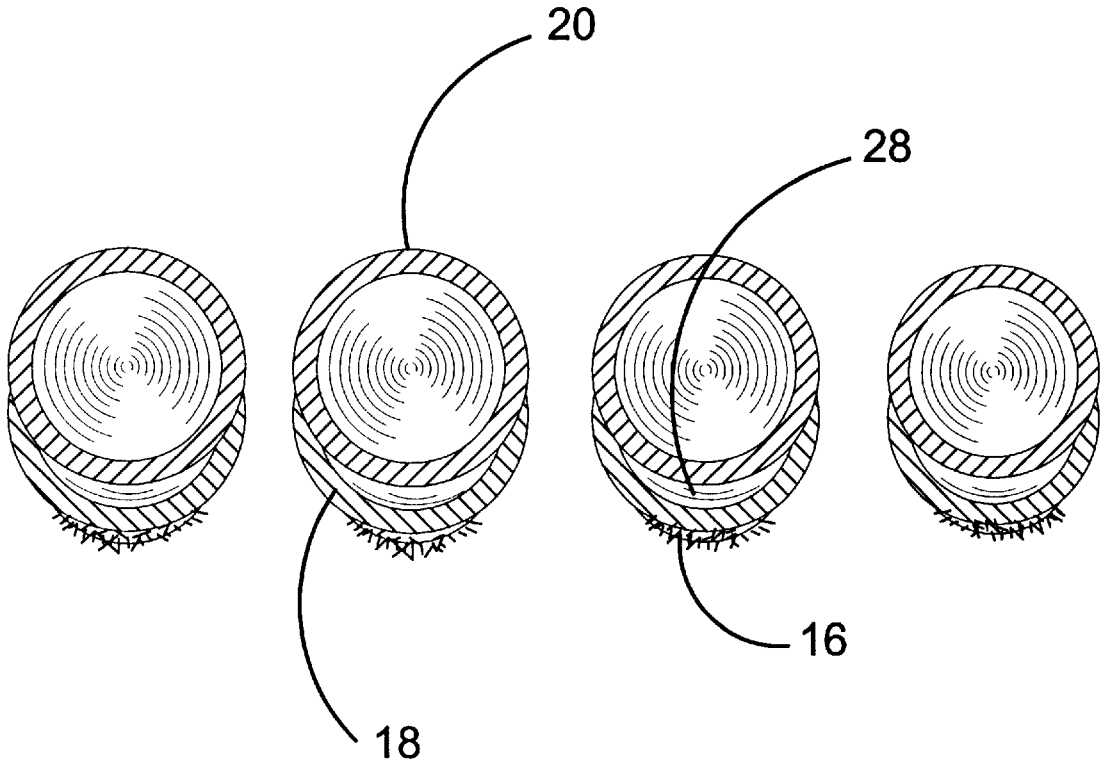
FIG. 4 is a cross section view of the present invention.

Turning to FIG. 4, shown therein is a cross section view of the present invention. Shown is the present invention having a glove body for the placement of the user's hand and fingers therein with an abrasive inner palm layer 18 attached to the bottom of the glove body 20 forming an inner storage cavity 28 where the soap apertures may dispense soap into. Cleaning members 16 are also shown.

Figure 5:
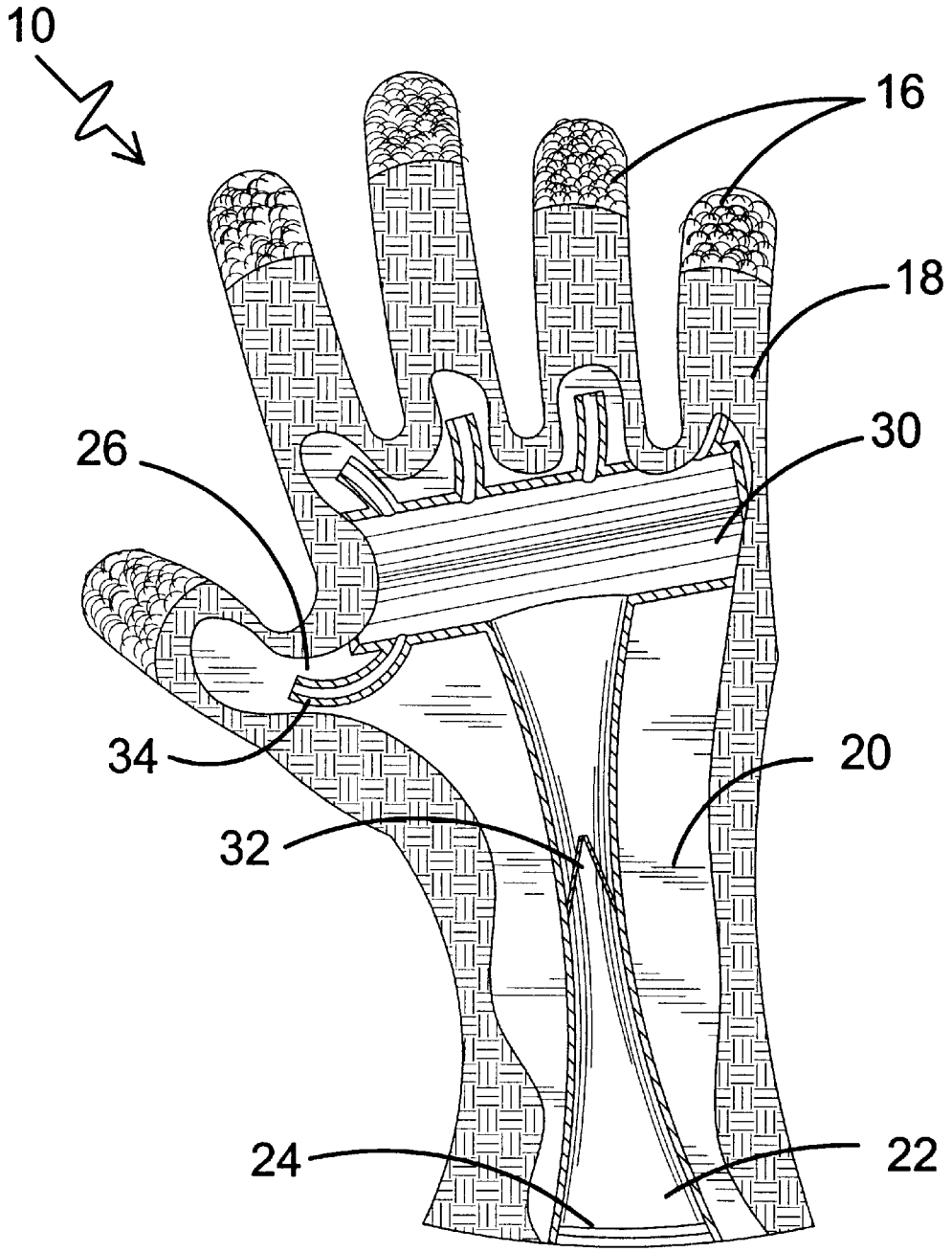
FIG. 5 is a cut away view of the present invention.

Turning to FIG. 5, shown therein is a cut away view of the present invention 10. Shown is the present invention having a soap containment bladder 30 with a plurality of conducts 34 having soap dispensing apertures 26 therein for the containment and the selective dispensing of the soap held within the bladder when it is squeezed. Also shown are a soap fill spout 22 and a one-way valve 32 to allow for filling of the bladder 30 and prevent egress of the cleaning solution when under pressure. Other elements previously disclosed are also shown.

Figure 6:
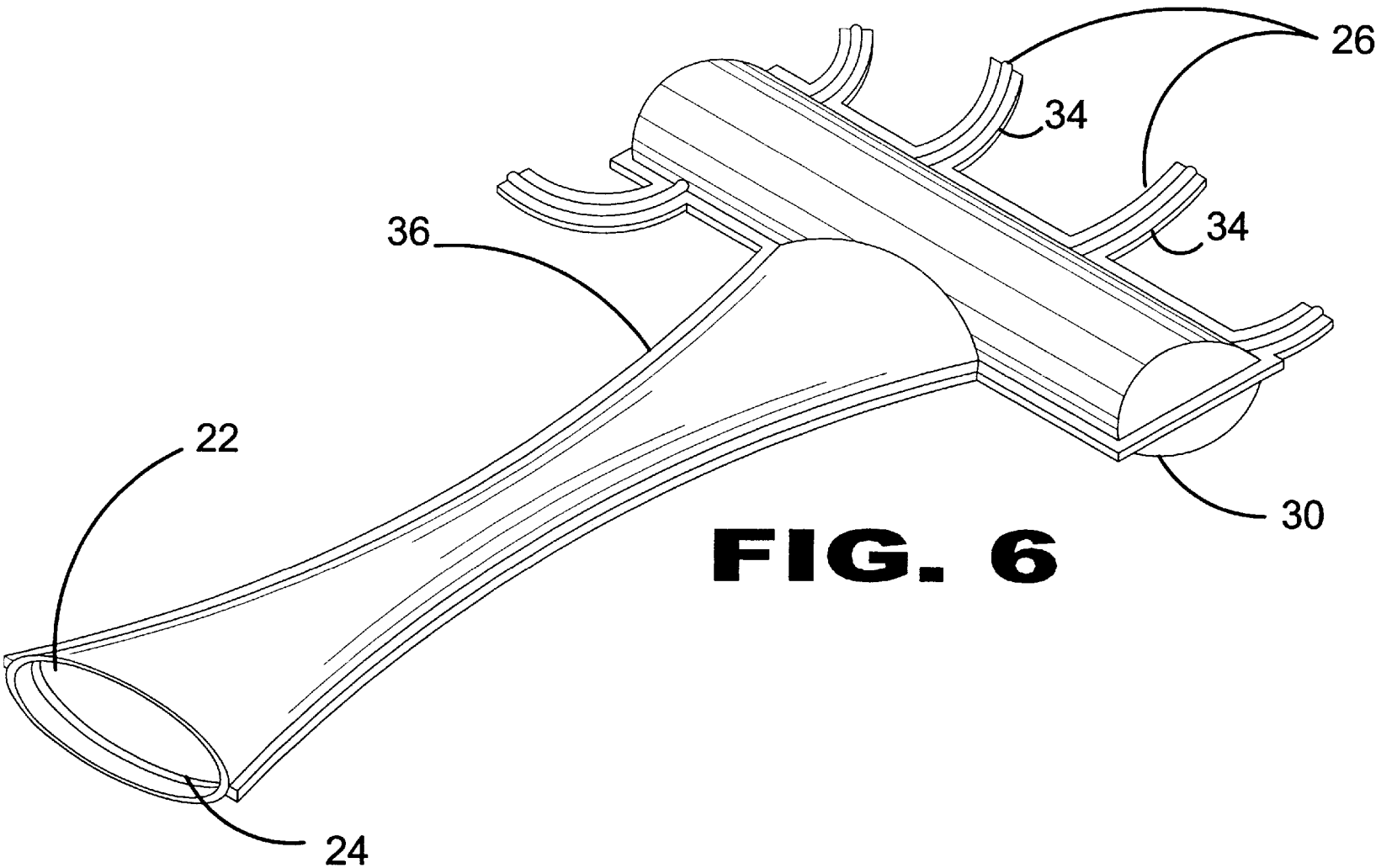
FIG. 6 is a perspective view of the containment bladder.

Turning to FIG. 6, shown therein is a perspective view of the soap containment bladder 30. Shown is the soap containment bladder 30 with a plurality of conduits 34 having soap dispensing apertures 26 therein to dispense the cleaning solution concentrations to appropriate areas of the abrasive inner palm layer. Also shown is a semi-rigid siding 36 to help the soap containment bladder 30 keep its shape inside the glove. Other elements previously disclosed are also shown.

Figure 7:
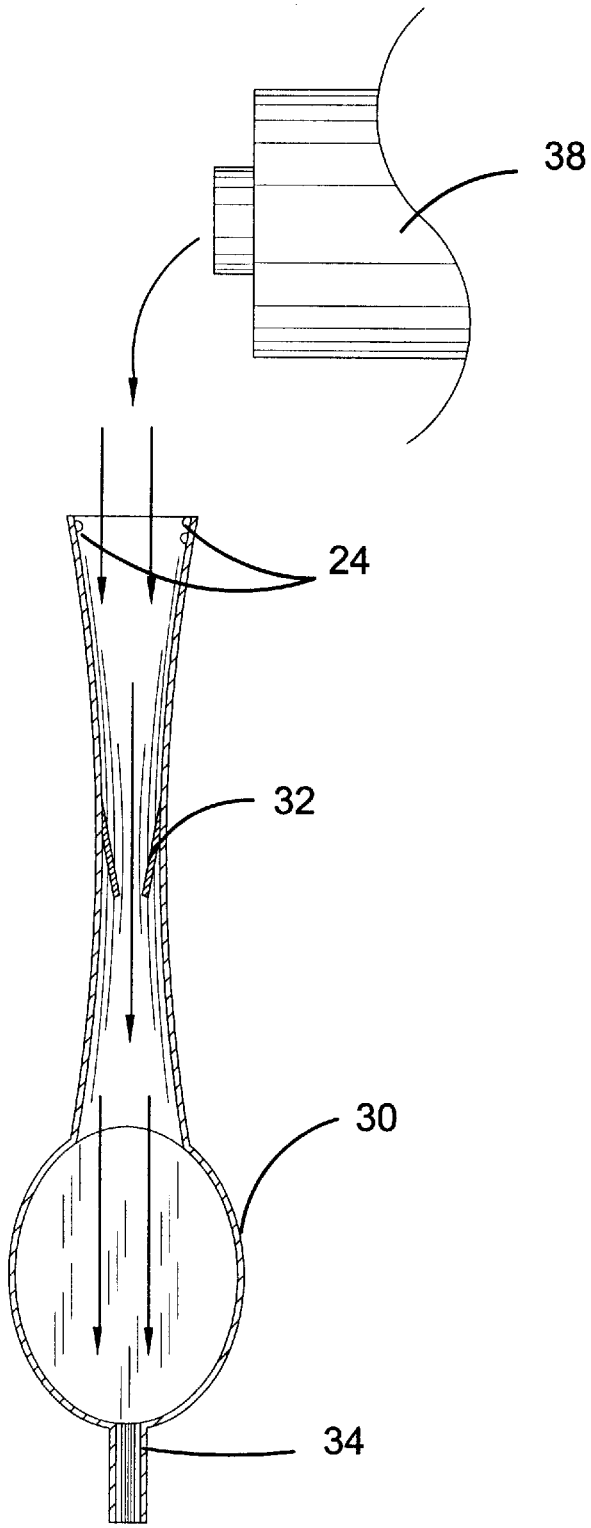
FIG. 7 is a sectional view of soap containment bladder.

Turning to FIG. 7, shown therein is a sectional view of the soap containment bladder 30. Shown is the soap containment bladder 30 being filled with a soap solution 38 having the one-way valve 32 in the open position. A soap-dispensing conduit 34 is also shown.

Figure 8:
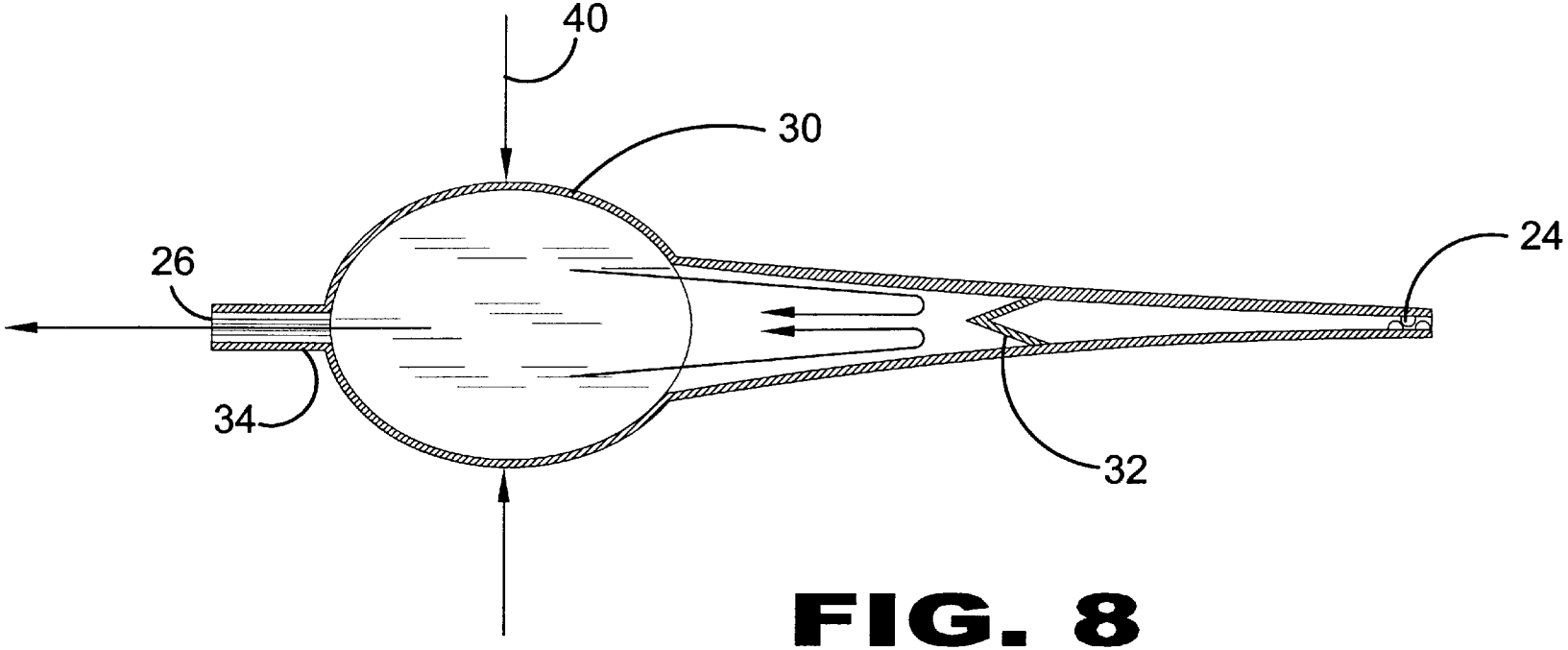
FIG. 8 is a sectional view of soap containment bladder.

Turning to FIG. 8, shown therein is a sectional view of the soap containment bladder 30. Shown is the soap containment bladder 30 having force (shown by arrows 40) applied to it causing pressure inside with the one-way valve 32 in the closed position causing the cleaning solution contained therein to be forced out through the soap dispensing conduits 34 and apertures 26. The interlocking liquid seal 24 is also shown.

Figure 9:
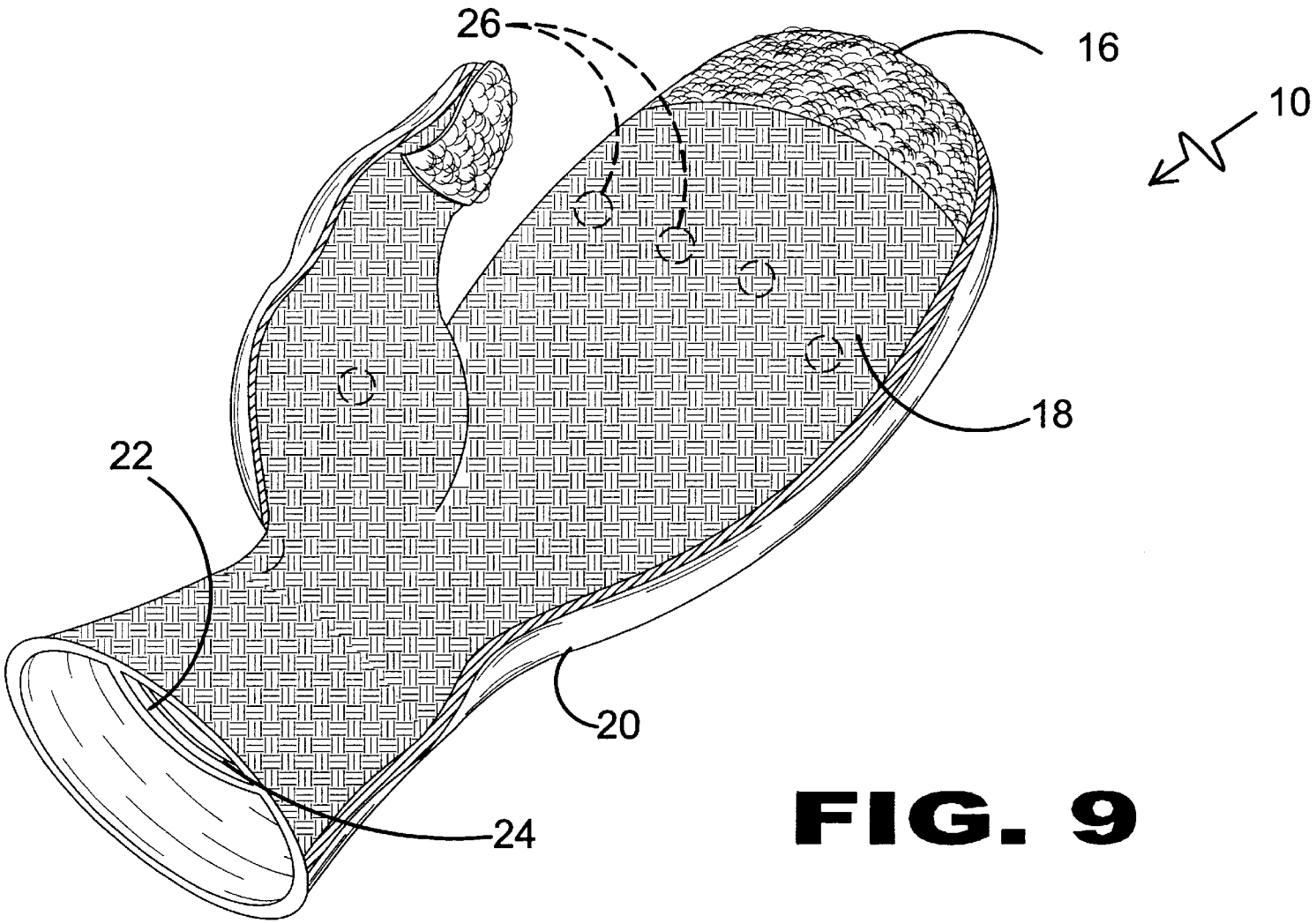
FIG. 9 is a isometric view of the present invention as a mitten.

Turning to FIG. 9, shown therein is a isometric view of the present invention 10 as a mitten. Shown is the present invention in a mitten form so that it may be used for situations where more surface area is needed such as heavy duty cleaning in an industrial or commercial application. This embodiment of the present invention 10 is constructed similarly as previously disclosed as would be done by one skilled in the art. Other elements previously disclosed are also shown.

I claim:

1. A scouring glove to be worn on the hand of a user, comprising:

a) a glove, said glove having a plurality of receptacles for the fingers and thumb of the user, said glove having a bottom and a defined wrist area, said wrist area having an opening therein;

b) an inner palm layer disposed on said bottom of said glove, said inner palm layer forming a cavity therein between said inner palm layer and said bottom of said glove, said inner palm layer being abrasive and permeable to soap;

c) a plurality of abrasive cleaning members disposed on the ends of each of said receptacles for the fingers and the thumb;

d) a soap fluid containment bladder disposed internal said glove for supplying soap; and e) said soap fluid containment bladder having a plurality of conduits disposed thereon for receiving soap from said bladder, said conduits having apertures disposed thereon for delivering soap to said cavity, an elongated soap fill spout formed of semi-rigid material having an inlet aperture therein, said inlet aperture disposed in said opening of said defined wrist area, and a seal disposed on said inlet aperture.

2. The apparatus of claim 1, further comprising a one-way valve disposed internal said elongated soap fill spout for containing soap fluid within the bladder.

3. The apparatus of claim 2, wherein said seal further comprises an interlocking seal member.

4. The apparatus of claim 3, wherein said bladder is disposed in the palm area of said glove.

* * * * *